US006550541B2

(12) United States Patent
Patel

(10) Patent No.: US 6,550,541 B2
(45) **Date of Patent: *Apr. 22, 2003**

(54) VALVE ASSEMBLY

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/848,901

(22) Filed: May 4, 2001

(65) Prior Publication Data

US 2001/0042626 A1 Nov. 22, 2001

Related U.S. Application Data

(63) Continuation-in-part of application No. 09/569,792, filed on May 12, 2000.

(51) Int. Cl.[7] ..... E21B 34/14

(52) U.S. Cl. ..... 166/386; 166/332.2; 166/334.4

(58) Field of Search ..... 166/386, 240, 166/331, 332.2, 332.3, 334.1, 334.2, 334.4

(56) References Cited

U.S. PATENT DOCUMENTS

| | | | | |
|---|---|---|---|---|
| 4,823,881 A | | 4/1989 | Streich | |
| 5,518,073 A | * | 5/1996 | Manke et al. | 166/240 |
| 5,529,126 A | | 6/1996 | Edwards | |
| 6,152,224 A | | 11/2000 | French | |
| 6,352,119 B1 | * | 3/2002 | Patel | 166/386 |

* cited by examiner

*Primary Examiner*—William Neuder
(74) *Attorney, Agent, or Firm*—Trop Pruner & Hu PC; Jamie A. Castano; Jeffrey E. Griffin

(57) ABSTRACT

An apparatus usable in a subterranean well includes a valve, a first mechanism and a second mechanism. The valve controls communication between an annular region that surrounds the valve and an inner passageway of the valve. The first mechanism causes the valve to transition from a first state to a second state in response to pressure in the annular region. The second mechanism causes the valve to transition between the first state and the second state in response to a pressure differential between the annular region and the inner passageway.

25 Claims, 14 Drawing Sheets

VALVE ASSEMBLY

This application is a continuation-in-part of U.S. patent application Ser. No. 09/569,792, filed on May 12, 2000.

BACKGROUND

Reversing and circulating valves are often used in a tubular string in a subterranean well for purposes of communicating fluid between the annular region that surrounds the string and a central passageway of the string. The valves may be operated via fluid pressure that is applied to the annular region, especially for the case in which gas exists in the central passageway of the string. Some of these valves are single shot devices that are run downhole closed and then opened in a one time operation. Valves that may be repeatedly opened and closed are typically complex devices that may have reliability problems and interfere with other valves in the string.

Thus, there is a continuing need for an arrangement that addresses one or more of the problems that are stated above.

SUMMARY

In an embodiment of the invention, a technique that is usable with a subterranean well includes running a valve downhole in a first state and changing the valve to a second state in response to pressure that is applied to an annular region that surrounds the valve. The valve is changed between the first and second states by regulating a differential pressure between the annular region and an inner passageway of the valve.

In another embodiment of the invention, an apparatus usable in a subterranean well includes a valve, a first mechanism and a second mechanism. The valve controls communication between an annular region that surrounds the valve and an inner passageway of the valve. The first mechanism cause the valve to transition from a first state to a second state in response to pressure in the annular region. The second mechanism causes the valve to transition between the first state and the, second state in response to a pressure differential between the annular region and the inner passageway.

Advantages and other features of the invention will become apparent from the following description, drawing and claims.

DETAILED DESCRIPTION

Figure 1:
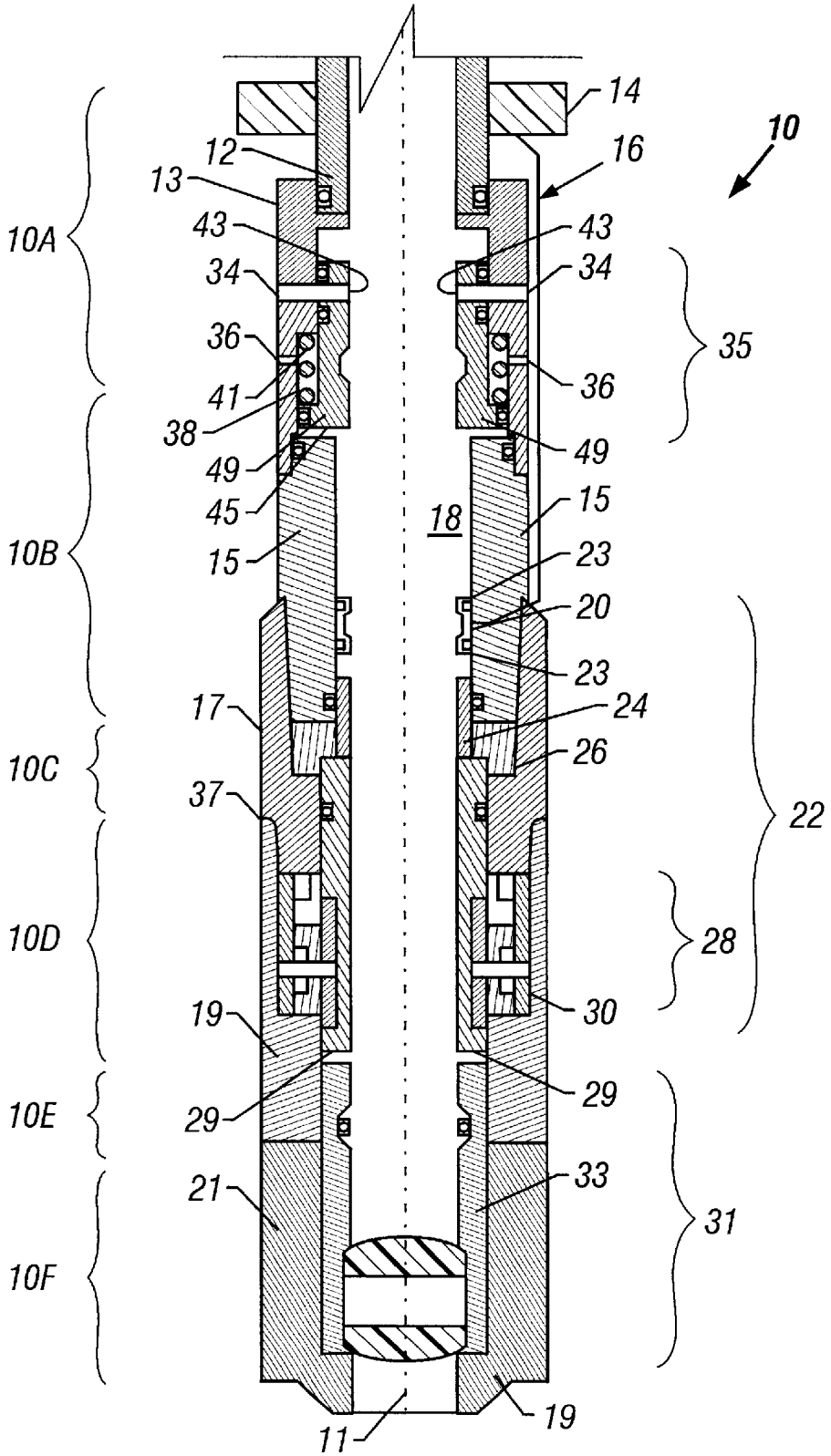
FIG. 1 is a schematic diagram of a completion valve assembly according to an embodiment of the invention.

Referring to FIG. 1, an embodiment 10 of a completion valve assembly in accordance with the invention include a hydraulically set packer 14 that is constructed to be run downhole as part of a tubular string. Besides the packer 14, the completion valve assembly 10 includes a tubing fill valve 35, a packer isolation valve 22 and a formation isolation valve 31. As described below, due to the construction of these tools, several downhole operations may be performed without requiring physical intervention with the completion valve assembly 10, such as a physical intervention that includes running a wireline tool downhole to change a state of the tool. For example, in some embodiments of the invention, the following operations may be performed without requiring physical intervention with the completion valve assembly 10: the tubing fill valve 35 may be selectively opened and closed at any depth so that pressure tests may be performed when desired; the packer 14 may be set with the tubing pressure without exceeding a final tubing pressure; the packer 14 may be isolated (via the packer isolation valve 22) from the internal tubing pressure while running the completion valve assembly 10 downhole or while pressure testing to avoid unintentionally setting the packer 14; and the formation isolation valve 31 may automatically open 31 (as described below) after the packer 14 is set.

More specifically, in some embodiments of the invention, the packer isolation valve 22 operates to selectively isolate a central passageway 18 (that extends along a longitudinal axis 11 of the completion valve assembly 10) from a control line 16 that extends to the packer 14. In this manner, the control line 16 communicates pressure from the central passageway 18 to the packer 14 so that the packer 14 may be set when a pressure differential between the central passageway 18 and a region 9 (call the annulus) that surrounds the completion valve assembly 10 exceeds a predetermined differential pressure threshold. It may be possible in conventional tools for this predetermined differential pressure threshold to unintentionally be reached while the packer is being run downhole, thereby causing the unintentional setting of the packer. For example, pressure tests of the tubing may be performed at various depths before the setting depth is reached, and these pressure tests, in turn, may unintentionally set the packer. However, unlike the conventional arrangements, the completion valve assembly 10 includes the packer isolation valve 22 that includes a cylindrical sleeve 20 to block communication between the control line 16 and the central passageway 18 until the packer 14 is ready to be set.

To accomplish this, in some embodiments of the invention, the sleeve 20 is coaxial with and circumscribes the longitudinal axis 11 of the completion valve assembly 10. The sleeve 20 is circumscribed by a housing section 15 (of the completion valve assembly 10) that include ports for establishing communication between the control line 16 and the central passageway 18. Before the packer 14 is set, the sleeve 20 is held in place in a lower position by a detent ring (not shown in FIG. 1) that resides in a corresponding annular slot (not shown in FIG. 1) that is formed in the housing section 15. In the lower position, the sleeve 20 covers the radial port to block communication between the control line 16 and the central passageway 18. O-rings 23 that are located in corresponding annular slots of the sleeve 20 form corresponding seals between the sleeve 20 and the housing section 15. When the packer 14 is to be set, a mandrel 24 may be operated (as described below) to dislodge the sleeve 20 and move the sleeve 20 to an upper position to open communication between the control line 16 and the central passageway 18. The sleeve 20 is held in place in its new upper position by the detent ring that resides in another corresponding annular slot (not shown in FIG. 1) of the housing section 15.

In some embodiments of the invention, the mandrel 24 moves up in response to applied tubing pressure in the central passageway 18 and moves down in response to the pressure exerted by a nitrogen gas chamber 26. The nitrogen gas chamber 26, in other embodiments of the invention, may be replaced by a coil spring or another type of spring, as examples. This operation of the mandrel 24 is attributable to an upper annular surface 37 (of the mandrel 24) that is in contact with the nitrogen gas in the nitrogen gas chamber 26 and a lower annular surface 29 of the mandrel 24 that is in contact with the fluid in the central passageway 18. Therefore, when the fluid in the central passageway 18 exerts a force (on the lower annular surface 29) that is sufficient to overcome the force that the gas in the chamber 26 exerts on the upper annular surface 37, a net upward force is established on the mandrel 24. Otherwise, a net downward force is exerted on the mandrel 24. As described below, the mandrel 24 moves down to force a ball valve operator mandrel 33 down to open a ball valve 31 after the packer 14 is set. However, as described below, the upward and downward travel of the mandrel 24 may be limited by an index mechanism 28 that controls when the mandrel 24 opens the packer isolation valve 22 and when the mandrel 24 opens the ball valve 31.

In this manner, the completion valve assembly 10, in some embodiments of the invention, includes an index mechanism 28 that limits the upward and downward travel of the mandrel 24. More particularly, the index mechanism 28 confines the upper and lower travel limits of the mandrel 24 until the mandrel 24 has made a predetermined number (eight or ten, as examples) of up/down cycles. In this context, an up/down cycle is defined as the mandrel 24 moving from a limited (by the index mechanism 28) down position to a limited (by the index mechanism 28) up position and then back down to the limited down position. A particular up/down cycle may be attributable to a pressure test in which the pressure in the central passageway 18 is increased and then after testing is completed, released.

After the mandrel 24 transitions through the predetermined number of up/down cycles, the index mechanism 28 no longer confines the upper travel of the mandrel 24. Therefore, when the central passageway 18 is pressurized again to overcome the predetermined threshold, the mandrel 24 moves upward beyond the travel limit that was imposed by the index mechanism 28; contacts the sleeve 20 of the packer isolation valve 22; dislodges the sleeve 20 and moves the sleeve 20 in an upward direction to open the packer isolation valve 22. At this point, the central passageway 18 may be further pressurized to the appropriate level to set the packer 14. After pressure is released below the predetermined pressure threshold, the mandrel 24 travels back down. However, on this down cycle, the index mechanism 28 does not set a limit on the lower travel of the mandrel 24. Instead, the mandrel 24 travels down; contacts the ball valve operator mandrel 33; and moves the ball valve operator mandrel 33 down to open the ball valve 31. Thus, after some predetermined pattern of movement of the mandrel 24, the mandrel 24 may on its upstroke actuate one tool, such as the packer isolation valve 22, and may on its downstroke actuate another tool, such as the ball valve 31. Other tools, such as different types of valves (as examples), may be actuated by the mandrel 24 after a predetermined movement in a similar manner, and these other tools are also within the scope of the appended claims.

The tubing fill valve 35 selectively opens and closes communication between the annulus and the central passageway 18. More particularly, the tubing fill valve 35 includes a mandrel 32 that is coaxial with and circumscribes the longitudinal axis 11 and is circumscribed by a housing section 13. When the tubing fill valve 35 is open, radial ports 43 in the mandrel 32 align with corresponding radial ports 34 in the housing section 13. The mandrel 32 is biased open by a compression spring 38 that resides an annular cavity that exists between the mandrel 32 and the housing section 13. The cavity is in communication with the fluid in the annulus via radial ports 36. The upper end of the compression spring 38 contacts an annular shoulder 41 of the housing section 13, and the lower end of the compression spring 38 contacts an upper annular surface 47 of a piston head 49 of the mandrel 32. A lower annular surface 45 of the piston head 49 is in contact with the fluid in the central passageway 18.

Therefore, due to the above-described arrangement, the tubing fill valve 35 operates in the following manner. When a pressure differential between the fluids in the central passageway 18 and the annulus is below a predetermined differential pressure threshold, the compression spring 38 forces the mandrel 32 down to keep the tubing fill valve 35 open. To close the tubing fill valve 35 (to perform tubing pressure tests or to set the packer 14, as examples), fluid is circulated at a certain flow rate through the radial ports 34 and 43 until the pressure differential between the fluids in the central passageway 18 and the annulus surpasses the predetermined differential pressure threshold. At this point, a net upward force is established to move the mandrel 32 upward to close off the radial ports 34 and thus, close the tubing fill valve 35.

In the proceeding description, the completion valve assembly 10 is described in more detail, including discussion of the above referenced tubing fill valve 35; packer isolation valve 22; and index mechanism 28. In this manner, sections 10A (FIG. 2), 10B (FIG. 3), 10C (FIG. 4), 10D (FIG. 5), 10E (FIG. 7) and 10F (FIG. 8) of the completion valve assembly 10 are described below.

Figure 2:
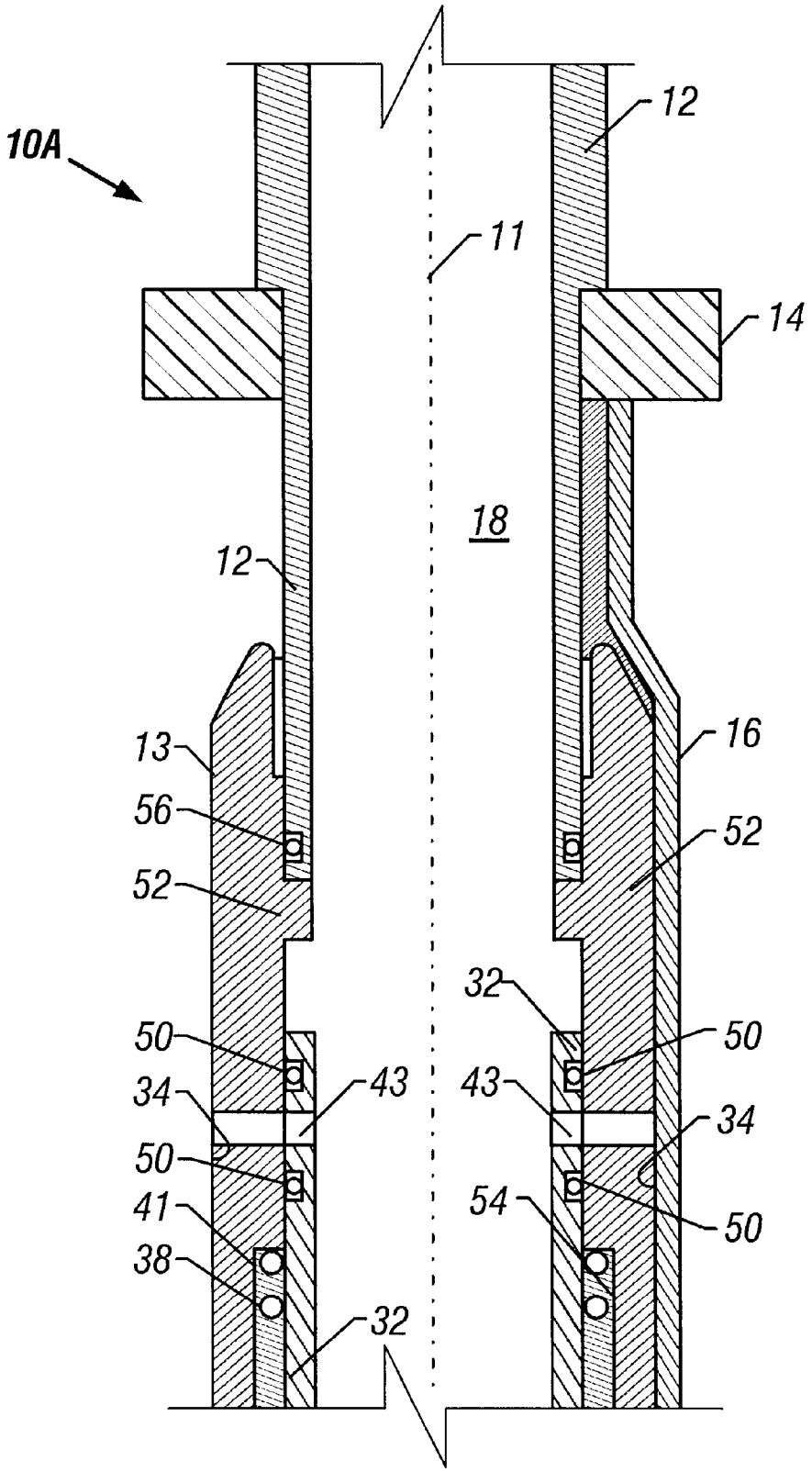
FIGS. 2, 3, 4, 5, 7 and 8 are more detailed schematic diagrams of sections of the completion valve according to an embodiment of the invention.

Referring to FIG. 2, the uppermost section 10A of the completion valve assembly 10 includes a cylindrical tubular section 12 that is circumscribed by the packer 14. The tubular section 12 is coaxial with the longitudinal axis 11, and the central passageway of the section 12 forms part of the central passageway 18. The upper end of the section 12 may include a connection assembly (not shown) for connecting the completion valve assembly 10 to a tubular string.

The tubular section 12 is received by a bore of the tubular housing section 13 that is coaxial with the longitudinal axis 11 and also forms part of the central passageway 18. As an example, the tubular section 12 may include a threaded section that mates with a corresponding threaded section that is formed inside the receiving bore of the housing section 13. The end (of the tubular section 12) that mates with the housing section 13 rests on a protrusion 52 (of the housing section 13) that extends radially inward. The protrusion 52 also forms a stop to limit the upward travel of the mandrel 32 of the tubing fill valve 35. An annular cavity 54 in the housing section 13 contains the compression springs 38. The mandrel 32 includes annular O-ring notches above the radial ports 43. These O-ring notches hold corresponding O-rings 50.

Figure 3:
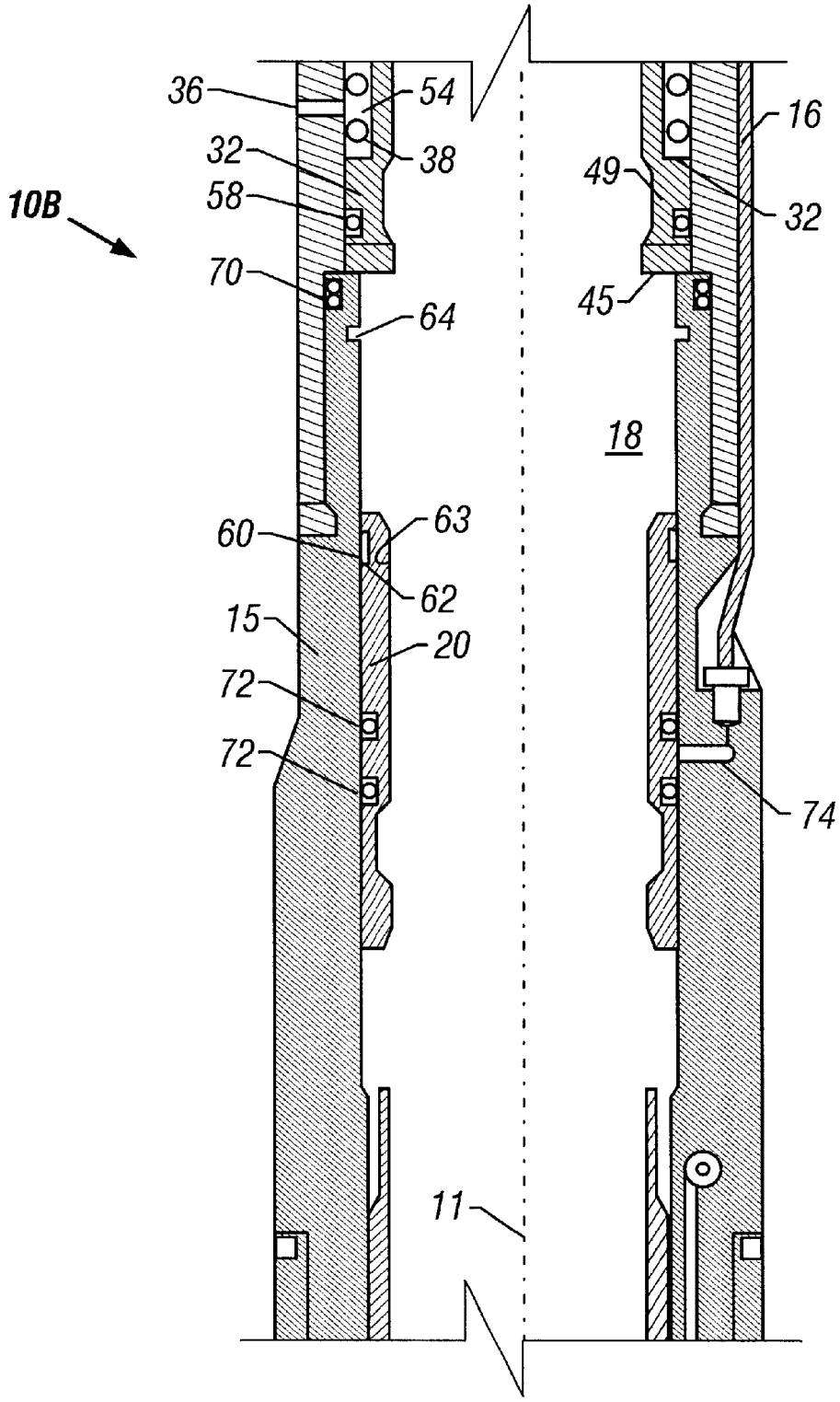

Referring to FIG. 3, in the section 10B of the completion valve assembly 10, the mandrel 32 includes an exterior annular notch to hold O-rings 58 to seal off the bottom of the chamber 54. The housing section 13 has a bore that receives a lower housing section 15 that is concentric with the longitudinal axis 11 and forms part of the central passageway 18. The two housing sections 13 and 15 may be mated by a threaded connection, for example. Near its upper end, the housing section 15 includes an annular notch 64 on its interior surface that has a profile for purposes of mating with a detent ring 60 when the packer isolation valve 22 is open. The detent ring 60 rests in an annular notch 63 that is formed on the interior of the sleeve 20 near the sleeve's upper end. When the packer isolation valve 22 is closed, the detent ring 60 rests in the annular notch 62 that is formed in the interior surface of the housing section 15 below the annular notch 64. When the packer isolation valve 22 is opened and the sleeve 20 moves to its upper position, the detent ring 60 leaves the annular notch 62 and is received into the annular notch 64 to lock the sleeve 20 in the opened position. O-ring seals 70 may be located in an exterior annular notch of the housing section 15 to seal the two housing sections 13 and 15 together. O-ring seals 72 may also be located in corresponding exterior annular notches in the sleeve 20 to seal off a radial port 74 (in the housing section 15) that is communication with the control line 16.

Figure 4:
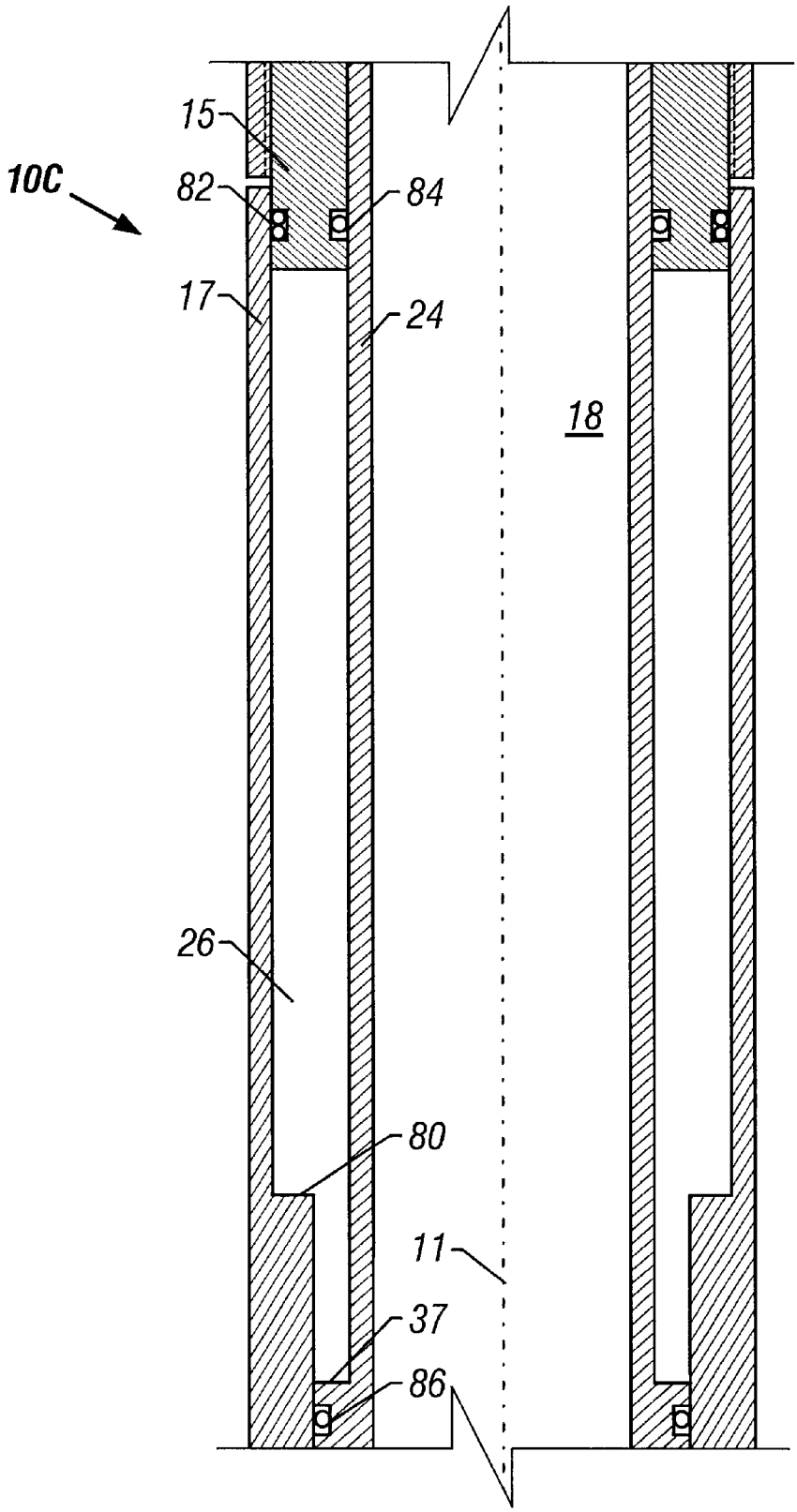

Referring to FIG. 4, the section 10C of the completion valve assembly 10 includes a generally cylindrical housing section 17 that is coaxial with the longitudinal axis 11 and includes a housing bore (see also FIG. 3) for receiving an end of the housing section 15. O-rings 82 reside in a corresponding exterior annular notch of the housing section 17 to seal the two housing sections 15 and 17 together. O-rings 84 are also located in a corresponding interior annular notch to form a seal between the housing section 15 and the mandrel 24 to seal off the nitrogen gas chamber 26. In this manner, the nitrogen gas chamber 26 is formed below the lower end of the housing section 15 and above an annular shoulder 80 of the housing section 17. An O-ring 86 resides in a corresponding exterior annular notch of the mandrel 24 to seal off the nitrogen gas chamber 26.

Figure 5:
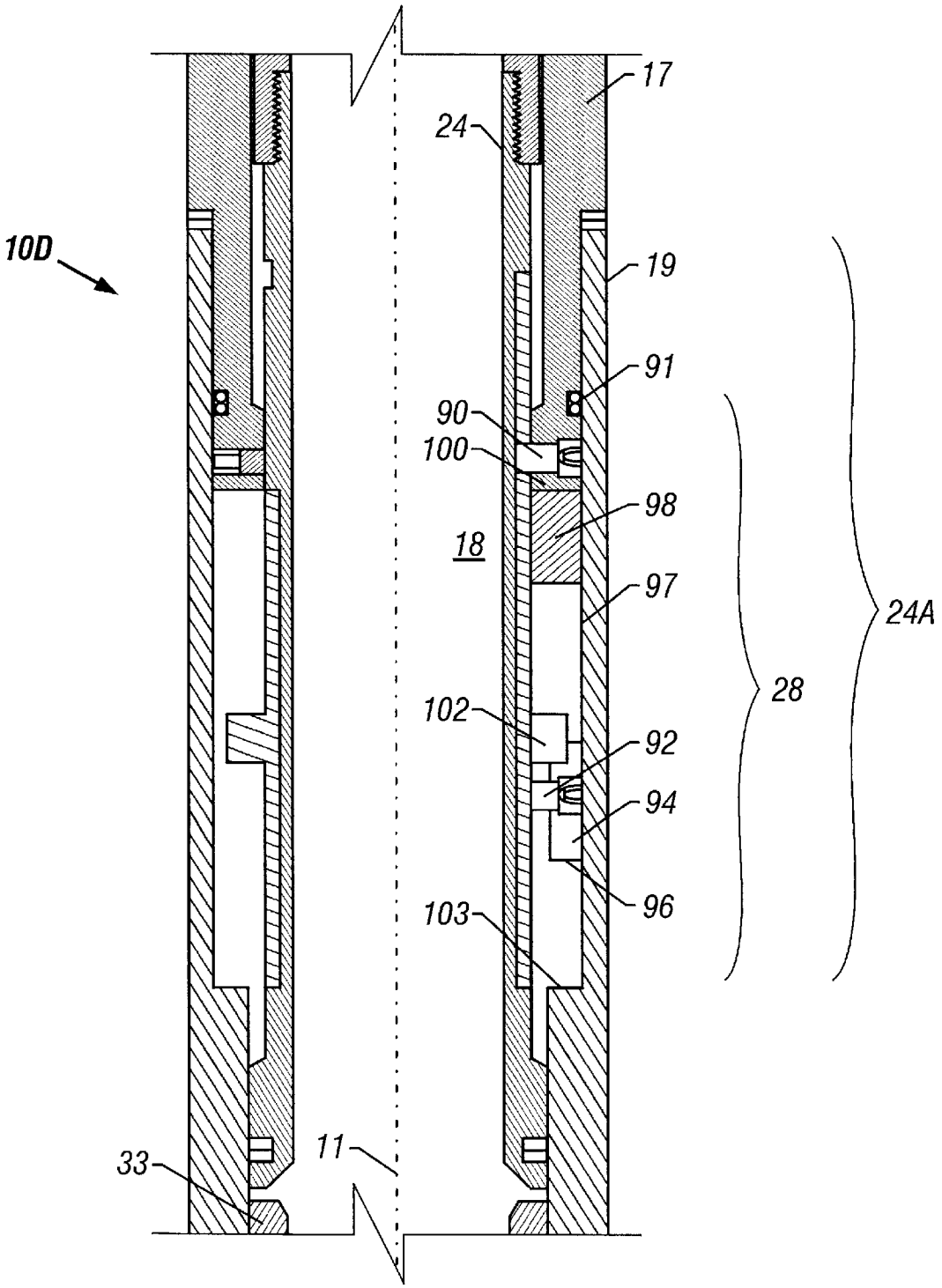

Referring to FIG. 5, in the section 10D of the completion valve assembly 10, the lower end of the housing section 17 is received into a bore of an upper end of a housing section 19. The housing section 19 is coaxial with and circumscribes the longitudinal axis 11. O-rings 91 reside in a corresponding exterior annular notch of the housing section 17 to seal the housing sections 17 and 19 together.

The index mechanism 28 includes an index sleeve 94 that is coaxial with the longitudinal axis of the tool assembly 10, circumscribes the mandrel 24 and is circumscribed by the housing section 19. The index sleeve 94 includes a generally cylindrical body 97 that is coaxial with the longitudinal axis of the tool assembly 20 and is closely circumscribed by the housing section 19. The index sleeve 94 includes upper 98 and lower 96 protruding members that radially extend from the body 97 toward the mandrel 24 to serve as stops to limit the travel of the mandrel 24 until the mandrel 24 moves through the predetermined number of up/down cycles. The upper 98 and lower 96 protruding members are spaced apart.

More specifically, the mandrel 24 includes protruding members 102. Each protruding member 102 extends in a radially outward direction from the mandrel 24 and is spaced apart from its adjacent protruding member 102 so that the protruding member 102 shuttles between the upper 98 and lower 96 protruding members. Before the mandrel 24 transitions through the predetermined number of up/down cycles, each protruding member 102 is confined between one of the upper 98 and one of the lower 96 protruding members of the index sleeve 94. In this manner, the upper protruding members 98, when aligned or partially aligned with the protruding members 102, prevent the mandrel 24 from traveling to its farthest up position to open the packer isolation valve 20. The lower protruding members 96, when aligned with the protruding members 102, prevent the mandrel 24 from traveling to its farthest down position to open the ball valve 31.

Each up/down cycle of the mandrel 24 rotates the index sleeve 94 about the longitudinal axis 11 by a predetermined angular displacement. After the predetermined number of up/down cycles, the protruding members 102 of the mandrel 24 are completely misaligned with the upper protruding members 98 of the index sleeve 94. However, at this point, the protruding members 102 of the mandrel 24 are partially aligned with the lower protruding members 96 of the index sleeve 94 to prevent the mandrel 24 from opening the ball valve 31. At this stage, the mandrel 24 moves up to open the packer isolation valve 20. The upper travel limit of the mandrel 24 is established by a lower end, or shoulder 100, of the housing section 17. The mandrel 24 remains in this far up position until the packer 14 is set. In this manner, after the packer 14 is set, the pressure inside the central passageway 18 is released, an even that causes the mandrel 24 to travel down. However, at this point the protruding members 102 of the mandrel 24 are no longer aligned with the lower protruding members 96, as the latest up/down cycle rotated the index sleeve 94 by another predetermined angular displacement. Therefore, the mandrel 24 is free to move down to open the ball valve 31, and the downward travel of the mandrel 24 is limited only by an annular shoulder 103 of the housing section 19.

Figure 6:
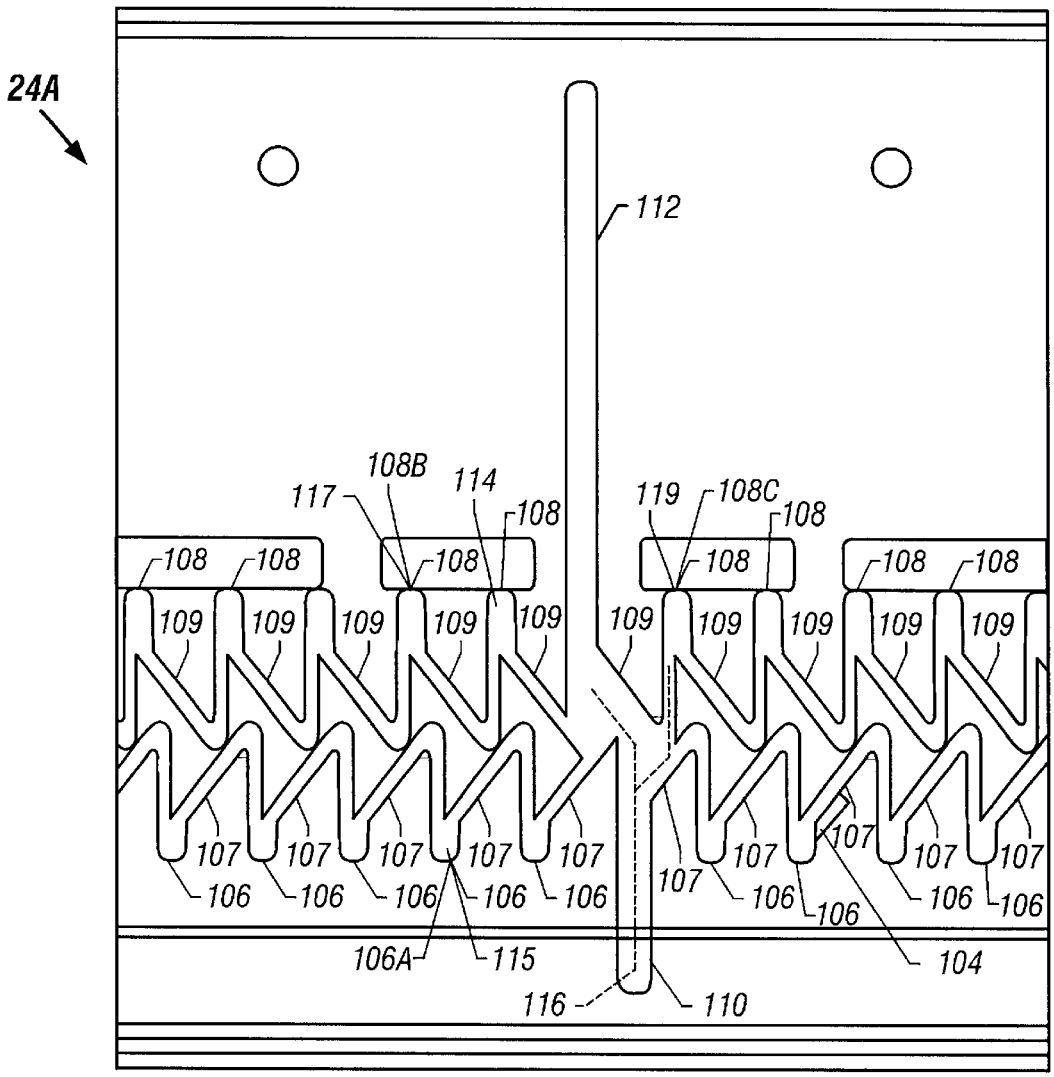
FIG. 6 is a schematic diagram of a flattened portion of a mandrel of the completion valve assembly depicting a J-sot according to an embodiment of the invention.

In some embodiments of the invention, a J-slot 104 (see also FIG. 6) may be formed in the mandrel 24 to establish the indexed rotation of the index sleeve 94. FIG. 6 depicts a flattened portion 24A of the mandrel 24. In this J-slot arrangement, one end of an index pin 92 (see FIG. 5) is connected to the index sleeve 94. The index pin 92 extends in a radially inward direction from the index sleeve 94 toward the mandrel 24 so that the other end of the index pin 92 resides in the J-slot 104. As described below, for purposes of preventing rotation of the mandrel 24, a pin 90 radially extends from the housing section 17 into a groove (of mandrel 24) that confines movement of the mandrel 24 to translational movement along the longitudinal axis 11, as described below.

As depicted in FIG. 6, the J-slot 104 includes upper grooves 108 (grooves 108*a*, 108*b* and 108*c*, as examples) that are located above and are peripherally offset from lower grooves 106 (groove 106*a*, as an example) of the J-slot 104. All of the grooves 108 and 106 are aligned with the longitudinal axis 11. The upper 108 and lower 106 grooves are connected by diagonal grooves 107 and 109. Due to this arrangement, each up/down cycle of the mandrel 24 causes the index pin 92 to move from the upper end of one of the upper grooves 108, through the corresponding diagonal groove 107, to the lower end of one of the lower grooves 106 and then return along the corresponding diagonal groove

109 to the upper end of another one of the upper grooves 108. The traversal of the path by the index pin 90 causes the index sleeve 94 to rotate by a predetermined angular displacement.

The following is an example of the interaction between the index sleeve 94 and the J-slot 104 during one up/down cycle. In this manner, before the mandrel 24 transitions through any up/down cycles, the index pin 92 resides at a point 114 that is located near the upper end of the upper groove 108*a*. Subsequent pressurization of the fluid in the central passageway 18 causes the mandrel 24 to move up and causes the index sleeve 94 to rotate. More specifically, the rotation of the index sleeve 94 is attributable to the translational movement of the index pin 92 with the mandrel 24, a movement that, combined with the produced rotation of the index sleeve 94, guides the index pin 92 (that does not rotate) through the upper groove 108*a*, along one of the diagonal grooves 107, into a lower groove 106*a*, and into a lower end 115 of the lower groove 106*a* when the mandrel 24 has moved to its farther upper point of travel. The downstroke of the mandrel 24 causes further rotation of the index sleeve 94. This rotation is attributable to the downward translational movement of the mandrel 24 and the produced rotation of the index sleeve 94 that guide the slot of the mandrel 24 relative to the index pin 92 from the lower groove 106*a*, along one of the diagonal grooves 109 and into an upper end 117 of an upper groove 108*b*. The rotation of the index sleeve 94 on the downstroke of the mandrel 24 completes the predefined angular displacement of the index sleeve 94 that is associated with one up/down cycle of the mandrel 24.

At the end of the predetermined number of up/down cycles of the mandrel 24, the index pin 92 rests near an upper end 119 of the upper groove 108*c*. In this manner, on the next up cycle, the index pin 92 moves across one of the diagonal grooves 107 down into a lower groove 110 that is longer than the other lower grooves 106. This movement of the index pin 92 causes the index sleeve 94 to rotate to cause the protruding members 102 of the mandrel 24 to become completely misaligned with the upper protruding members 98 of the index sleeve 94. As a result, the index pin 92 travels down into the lower groove 110 near the lower end 116 of the lower groove 110 as the mandrel 24 travels in an upward direction to open the packer isolation valve 14. When the mandrel 24 subsequently travels in a downward direction, the index pin 92 moves across one of the diagonal grooves 109 down into an upper groove 112 that is longer than the other upper grooves 106. This movement of the index pin 90 causes the index sleeve 92 to rotate to cause the protruding members 102 of the mandrel 24 to become completely misaligned with the lower protruding members 96 of the index sleeve 94. As a result, the index pin 92 travels up into the upper groove 112 as the mandrel 24 travels in a downward direction to open the packer isolation valve 14.

The index pin 90 (see FIG. 5) always travels in the upper groove 112. Because the index pin 90 is secured to the housing section 19, this arrangement keeps the mandrel 24 from rotating during the rotation of the index sleeve 94.

Figure 7:
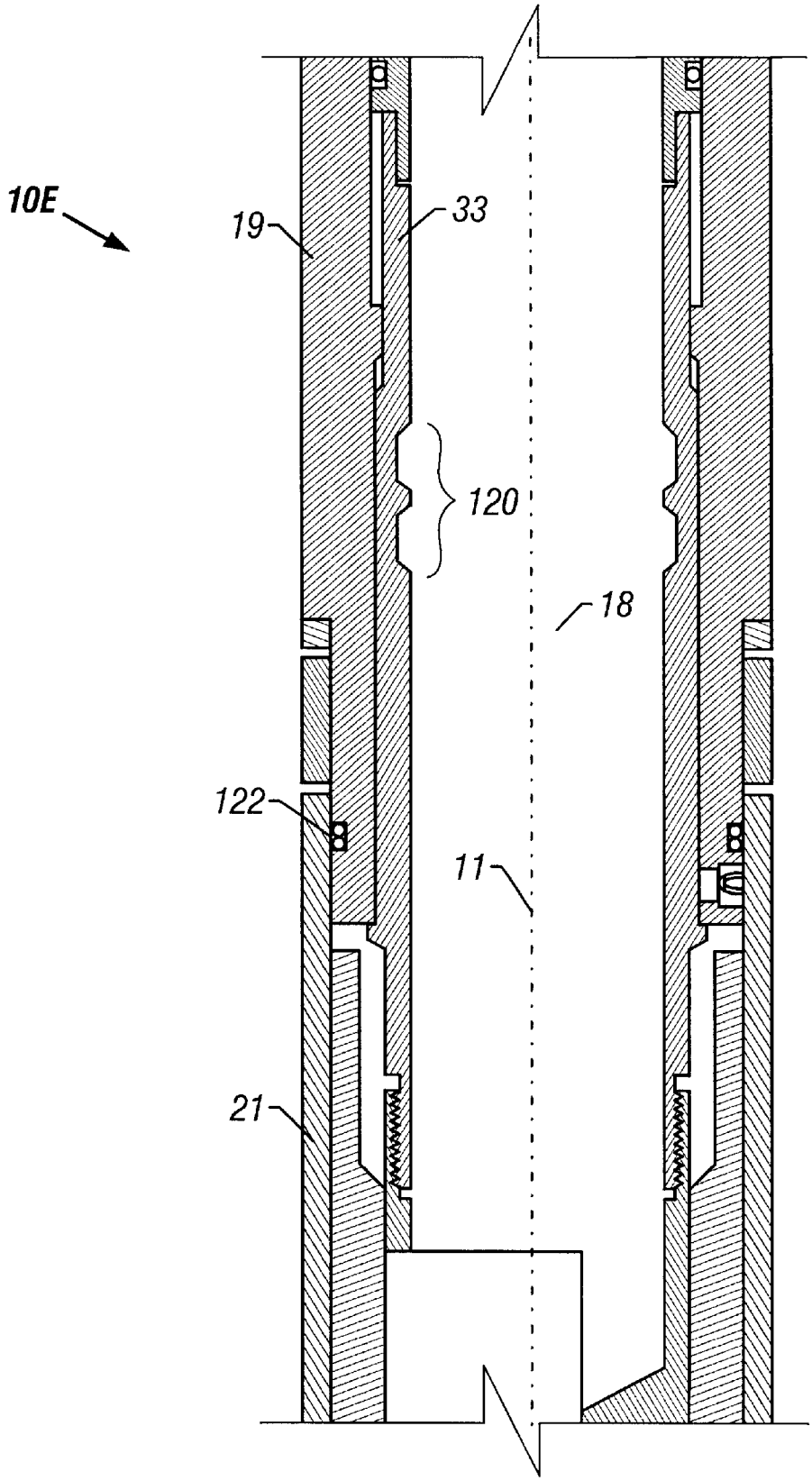
Figure 8:
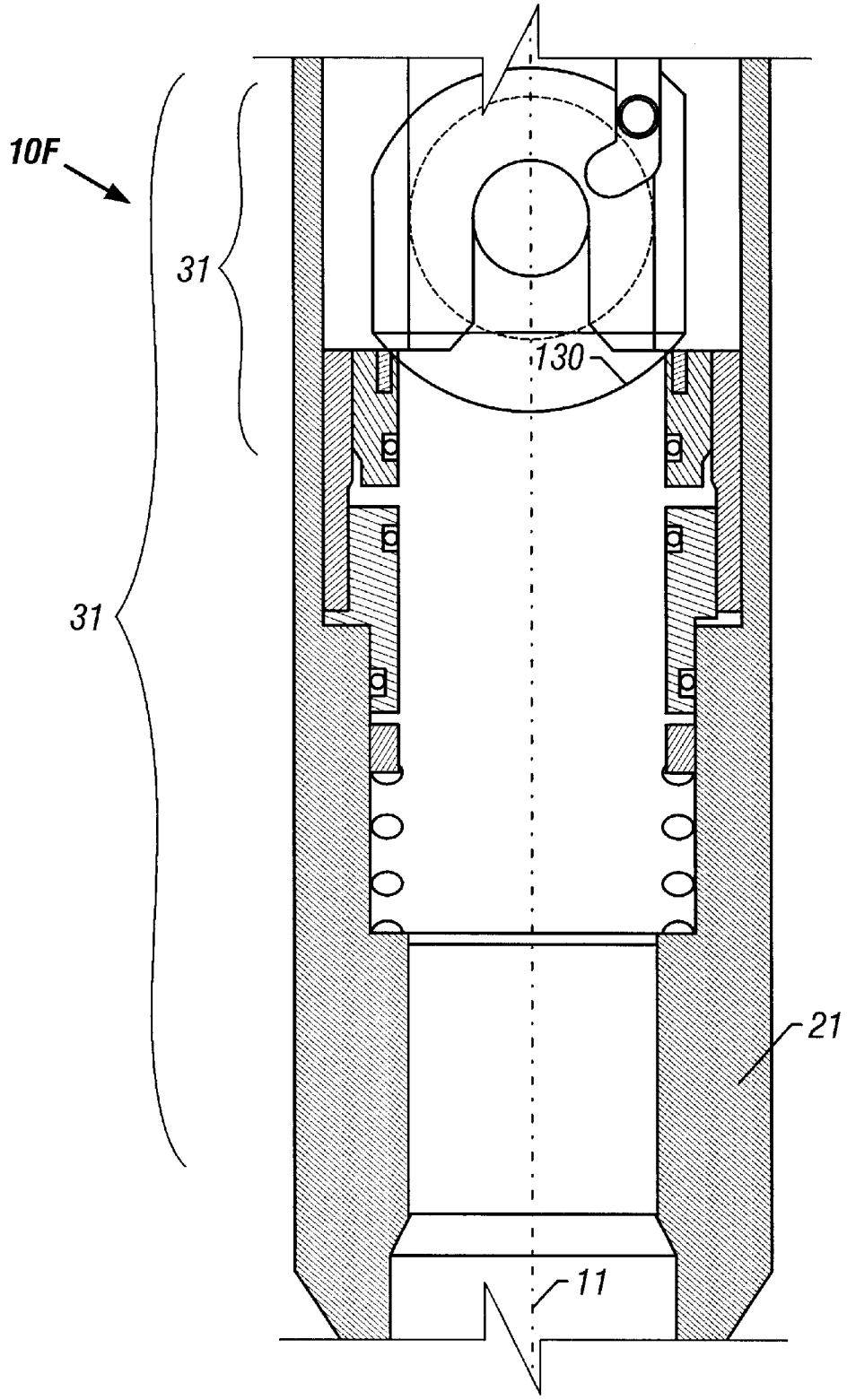

Referring to FIG. 7, in a section 10E of the completion valve assembly 10, the lower end of the housing section 19 is received by a bore of a lower housing section 21 that is coaxial with the longitudinal axis 11 and forms part of the central passageway 18. O-rings are located in an exterior annular notch of the housing section 19 to seal the two housing sections 19 and 21 together. Referring to FIG. 8, the mandrel 33 operates a ball valve element 130 that is depicted in FIG. 8 in its closed position. There are numerous designs for the ball valve 31, as can be appreciated by those skilled in the art.

Figure 9:
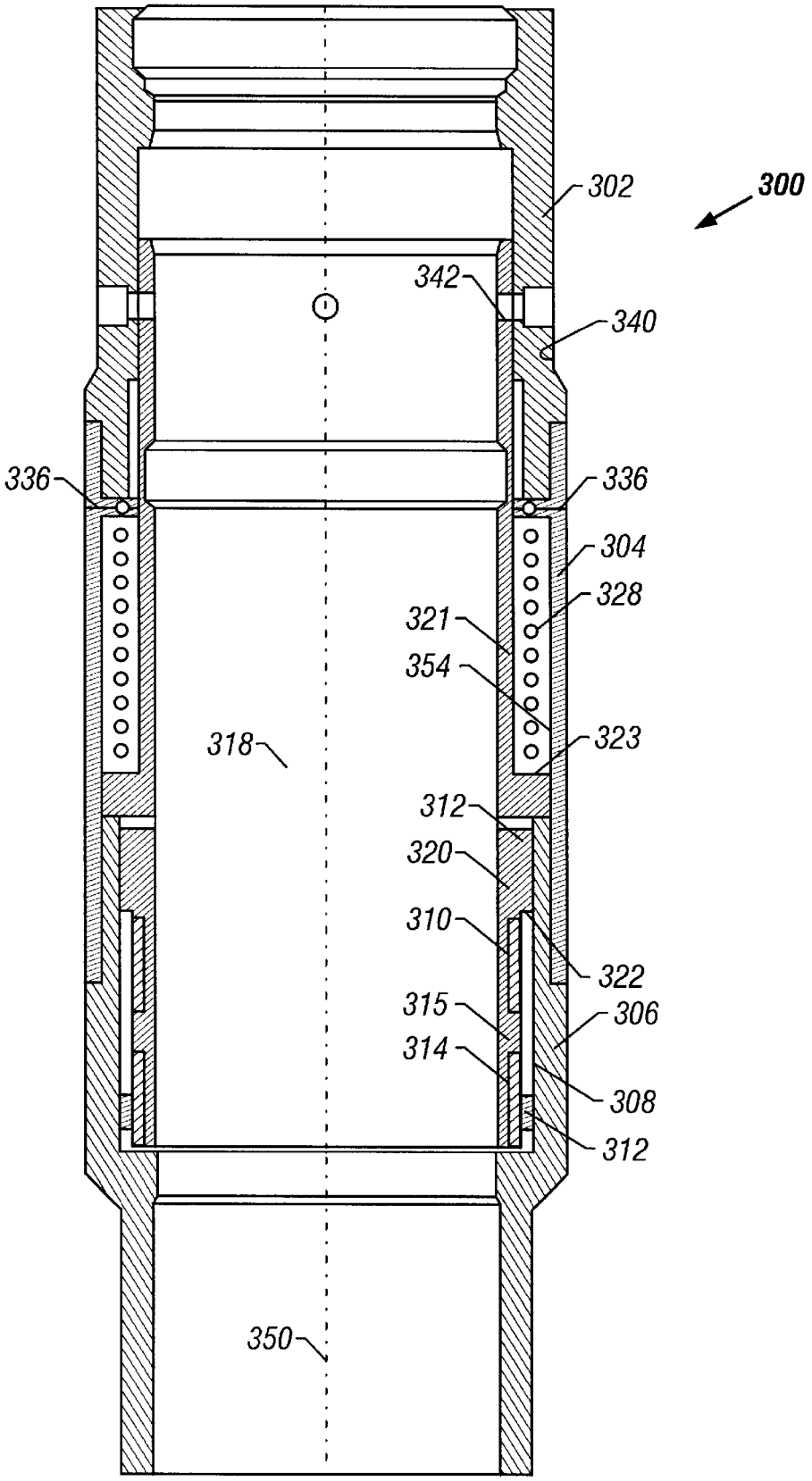
FIG. 9 is a schematic diagram of a tubing fill valve according to an embodiment of the invention.

Other embodiments are within the scope of the following claims. For example, FIG. 9 depicts a tubing fill valve 300 that may be used in place of the tubing fill valve 35. Unlike the tubing fill valve 35, the tubing fill valve 300 locks itself permanently in the closed position after a predetermined number of open and close cycles.

More particularly, the tubing fill valve 300 includes a mandrel 321 that is coaxial with a longitudinal axis 350 of the tubing fill valve 300 and forms part of a central passageway 318 of the valve 300. The mandrel 321 includes radial ports 342 that align with corresponding radial ports 340 of an outer tubular housing 302 when the tubing fill valve 300 is open. The mandrel 321 has a piston head 320 that has a lower annular surface 322 that is in contact with fluids inside the central passageway 318. An upper annular surface 323 of the piston head 320 contacts a compression spring 328. Therefore, similar to the design of the tubing fill valve 35, when the fluid is circulated through the ports 340, the pressure differential between the central passageway 318 and the annulus increases due to the restriction of the flow by the ports 340. When this flow rate reaches a certain level, this pressure differential exceeds a predetermined threshold and acts against the force that is supplied by the compression spring 328 to move the mandrel 321 upwards to close communication between the annulus and the central passageway 318.

Unlike the tubing fill valve 35, the tubing fill valve 300 may only subsequently re-open a predetermined number of times due to a ratchet mechanism. More specifically, this ratchet mechanism includes ratchet keys 314, ratchet lugs 312 and flat springs 310. Each ratchet key 314 is located between the mandrel 321 and a housing section 306 and partially circumscribes the mandrel 321 about the longitudinal axis 350. The ratchet key 314 has annular cavities, each of which houses one of the flat spring 310. The flat springs 310, in turn, maintain a force on the ratchet key 314 to push the ratchet key 314 in a radially outward direction toward the housing section 306.

Figure 10:
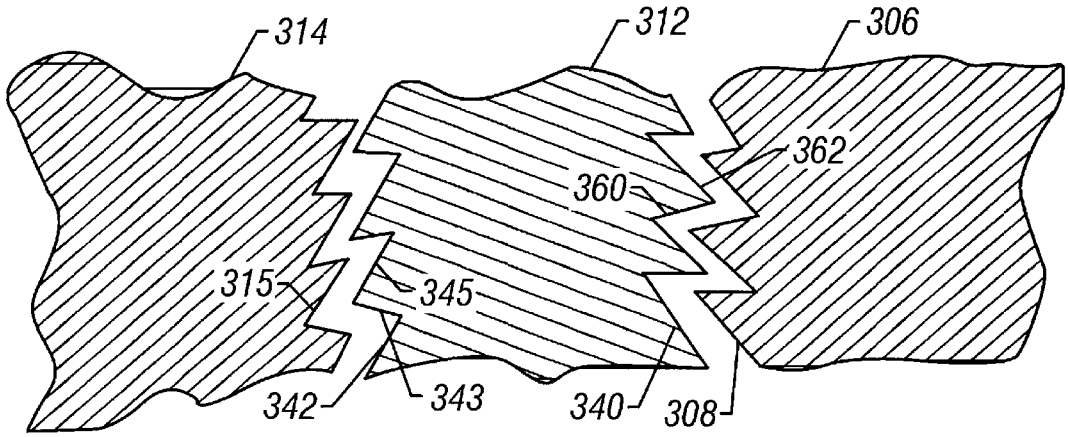
FIG. 10 is a schematic diagram of a ratchet mechanism of the tubing fill valve according to an embodiment of the invention.

Each ratchet lug 312 is located between an associated ratchet key 314 and the housing section 306. Referring also to FIG. 10 that depicts a more detailed illustration f the ratchet key 314, lug 312 and housing section 306, the ratchet lug 312 has interior profiled teeth 342 and exterior profiled teeth 340. As an example, each tooth of the interior profiled teeth 342 may include a portion 343 that extends radially between the ratchet lug 312 and the ratchet key 314 and an inclined portion 345 that extends in an upward direction from the ratchet key 314 to the ratchet lug 312. The ratchet key 314 also has profiled teeth 315 that are complementary to the teeth 342 of the ratchet lug 312. The exterior profiled teeth 340 of the ratchet lug 312 includes a portion 360 that extends radially between the ratchet lug 312 and the housing section 306 and an inclined portion 362 that extends in an upward direction from the housing section 306 to the ratchet lug 312. The housing 306 has profiled teeth 308 that are complementary to the teeth 340 of the ratchet lug 312.

Due to this arrangement, the ratchet mechanism operates in the following manner. The tubing fill valve 300 is open when the completion valve assembly 10 is run downhole. Before the tubing fill valve 300 is closed for the first time, the ratchet lugs 312 are positioned near the bottom end of the mandrel 321 and near the bottom end of the teeth 308 of the housing section 306. When the rate of circulation between the central passageway 318 and the annulus increases to the point that a net upward force moves the mandrel 321 in an upward direction, the ratchet lugs 312 move with the mandrel 321 with respect to the housing section 306. In this manner, due to the flat springs 310 and the profile of the teeth, the ratchet lugs 312 slide up the housing section 306.

When the tubing fill valve 300 re-opens and the mandrel 321 travels in a downward direction, the ratchet lugs 312 remain stationary with respect to the housing section 306 and slip with respect to the mandrel 321. The next time the tubing fill valve 300 closes, the ratchet lugs 312 start from higher positions on the housing section 306 than their previous positions from the previous time. Thus the ratchet lugs 312 effectively move up the housing section 306 due to the opening and closing of the tubing fill valve 35.

Eventually, the ratchet lugs 312 are high enough (such as at the position 312' that is shown in FIG. 9) to serve as a stop to limit the downward travel of the mandrel 321. In this manner, after the tubing fill valve 300 has closed a predetermined number of times, the lowered surface 322 of the piston head 320 contacts the ratchet lugs 312. Thus, the mandrel 321 is prevented from traveling down to re-open the tubing fill valve 300, even after the pressure in the central passageway 318 is released.

Among the other features of the tubing fill valve 300, the valve 300 may be formed from a tubular housing that includes the tubular housing section 302, a tubular housing section 304 and the tubular housing section 306, all of which are coaxial with the longitudinal axis 350. The housing section 304 has a housing bore at its upper end that receives the housing section 302. The two housing sections 302 and 304 may be threadably connected together, for example. The housing section 304 may also have a housing bore at its lower end to receive the upper end of the housing section 306. The two housing sections 304 and 306 may be threadably connected together, for example.

Figure 11:
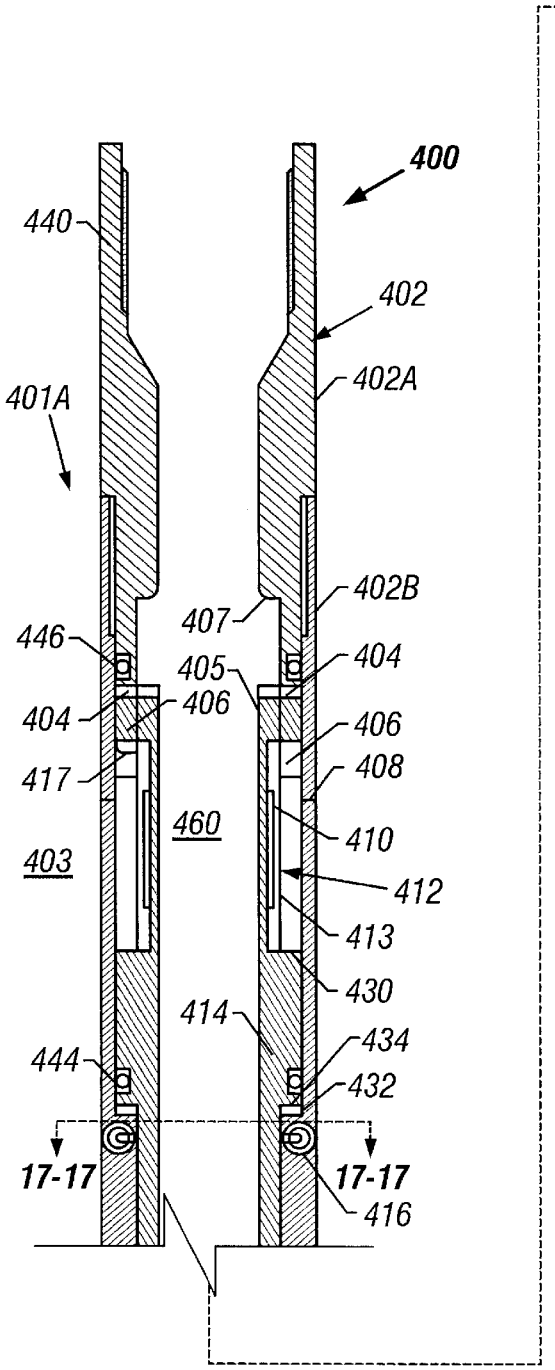
FIGS. 11 and 12 are schematic diagrams of sections of a valve assembly in a closed state according to an embodiment of the invention.
Figure 13:
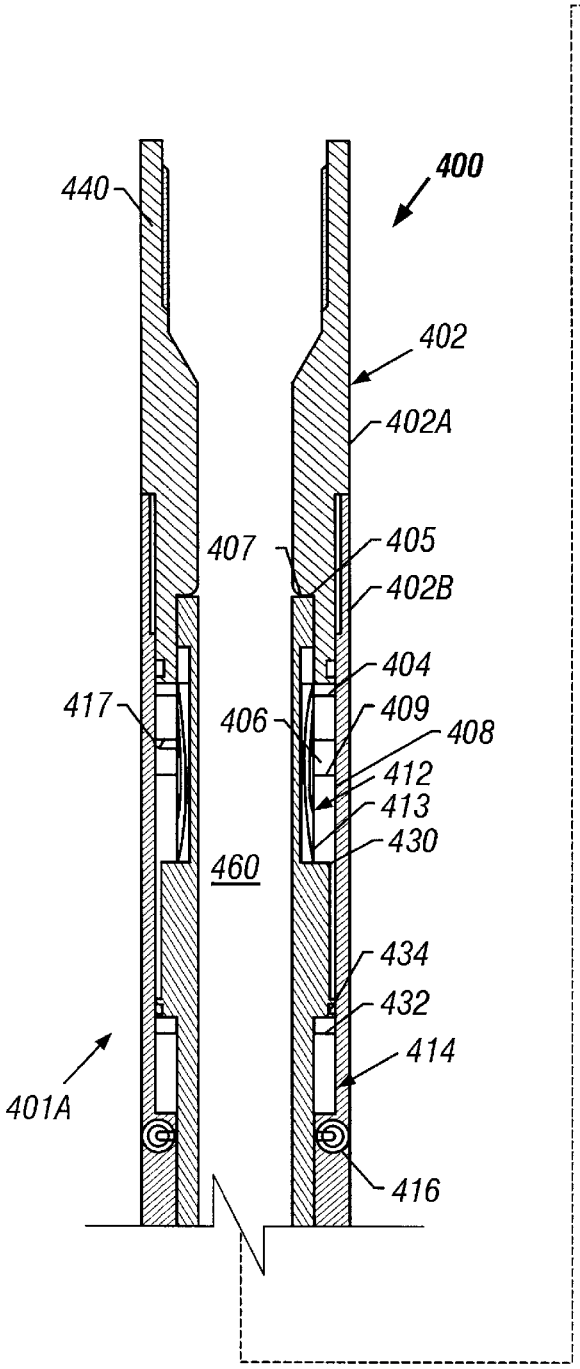
FIGS. 13 and 14 are schematic diagrams of sections of the valve assembly in an open state according to an embodiment of the invention.

In accordance with another embodiment of the invention, FIGS. 11 (depicting an upper 401*a* section) and 12 (depicting a lower 401*b* section) depict a valve assembly 400 in a closed state, and FIGS. 13 (depicting the upper 401*a* section) and 14 (depicting the lower 401*b* section) depict the assembly 400 in an open state. In some embodiments of the invention, the valve assembly 400 may be run downhole as part of a tubular string and control communication between a inner central passageway 460 of the valve assembly 400 and an annular region 403 that surrounds the valve assembly 400. Thus, the valve assembly 400 may serve as a circulating valve, in some embodiments of the invention.

The valve assembly 400 includes a housing 402 that is formed from upper 402*a*, middle 402*b* and lower 402*c* sections. The upper housing section 402*a* may include a mechanism (threads 440, for example) to couple the valve assembly 400 in line with the tubular string. The upper housing section 402*a* is coaxial with and extends into an upper end of the middle housing section 402*b*. The middle housing section 402*b*, in turn, receives the upper end of the lower housing 402*c*, a housing section that is also coaxial with the housing sections 402*b* and 402*c*.

For purposes of controlling communication between the annular region 403 that surrounds the valve assembly 400 and the central passageway 460, the valve assembly 400 includes an operator mandrel 414 that is circumscribed at least in part by the upper housing section 402*a* and the middle housing section 402*b*.

Figure 12:
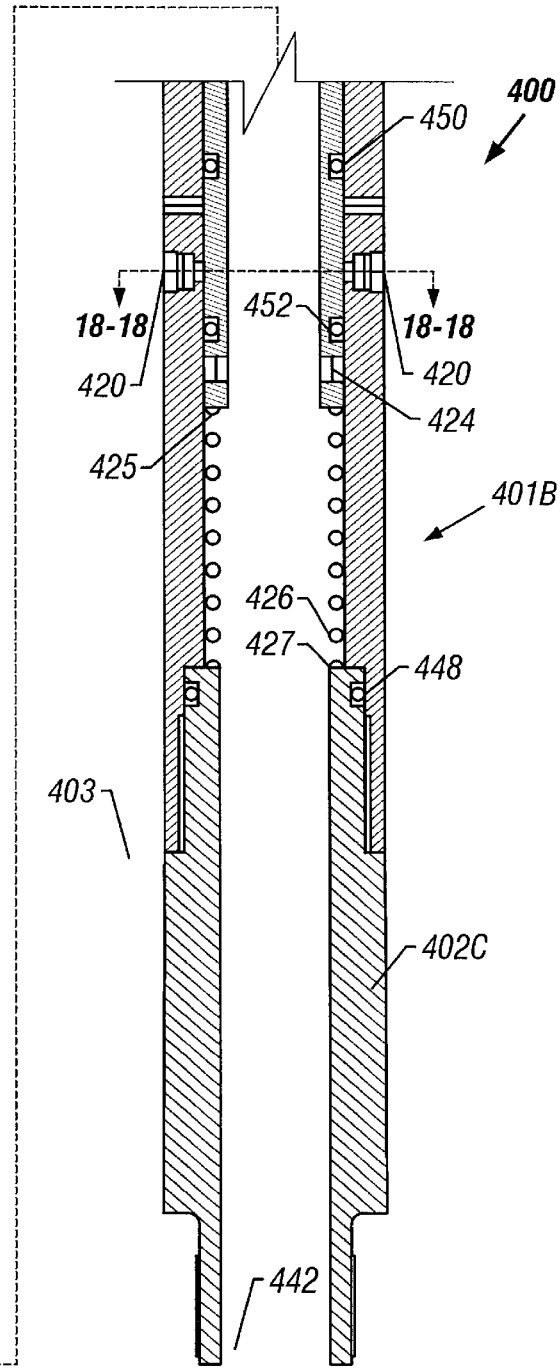
Figure 14:
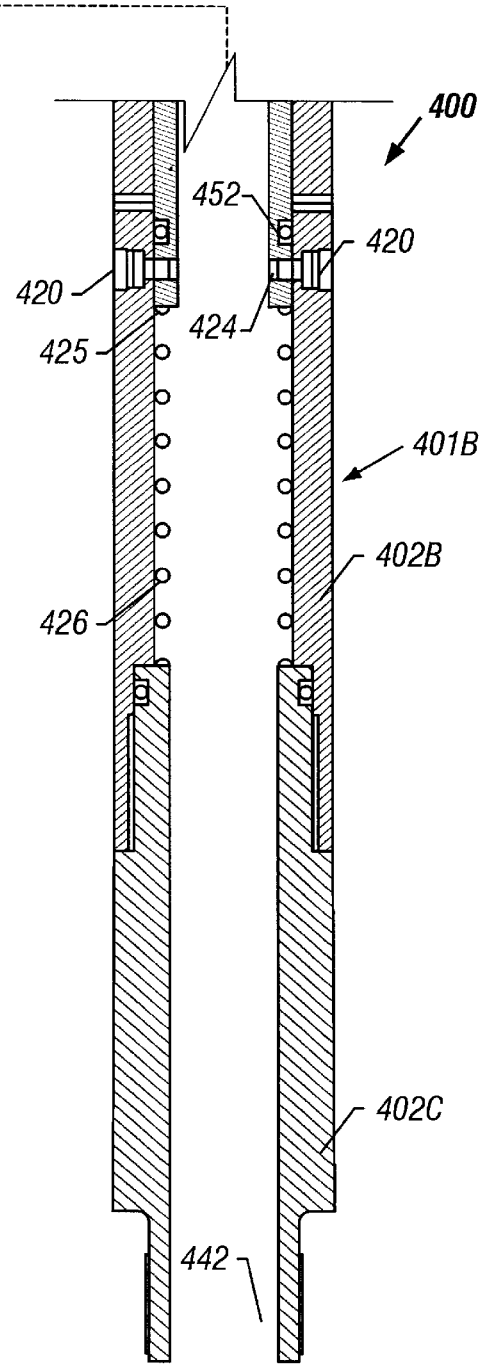

As described below, the fluid communication between the central passageway 460 and the annular region 403 is isolated (i.e., the valve assembly 400 is closed) when the mandrel 414 is in its lower position (as depicted in FIGS. 11 and 12), and communication is permitted (i.e., the valve assembly is open) when the mandrel 414 travels to its upper position, a position that is depicted in FIGS. 13 and 14.

In the mandrel's upper position, radial flow ports 420 that are formed in the middle housing section 402*b* are aligned with corresponding radial flow ports 424 of the mandrel 414, as depicted in FIGS. 13 and 14. However, when the mandrel 414 is in its lower position (the position depicted in FIGS. 11 and 12), the radial ports 424 of the mandrel 414 are located below the radial ports 420 of the middle housing section 402*b*, thereby blocking fluid communication between the annular region 403 and the central passageway 460 via the valve assembly 400. In this manner, in this lower position, upper 450 and lower 452 O-rings that are located between the mandrel 414 and the middle housing section 401*b* seal off the radial ports 420 from the central passageway 460.

A compression spring 426 of the valve assembly 400 is coaxial with the longitudinal axis of the valve assembly 400, has a lower end that abuts an inwardly protruding upper shoulder 427 of the lower housing section 402*c* and has an upper end that contacts the lower end 425 of the mandrel 414. Therefore, the compression spring 426 exerts an upward force that tends to keep the mandrel 414 in its upper position to keep the valve assembly 400 open. However, the mandrel 414 is initially confined to the lower position (or closed position) by shear pins 404, each of which is attached to the upper housing section 402*a* and extends radially inwardly from the upper housing section 402*a*. The shear pins 404 initially prevent upper movement of the mandrel 414 by extending above an upper shoulder 405 of the mandrel 414.

Thus, when the valve assembly 400 is initially run downhole, the mandrel 414 is held in its lower position (thereby closing the valve 400) via the shear pins 404. Once positioned downhole, the valve assembly 400 may then be opened by the application of pressure in the annular region 403. For example, a packer may be set downhole below the valve assembly 400 to create an annulus (containing the annular region 403) through which pressure may be communicated through a hydrostatic column of fluid, for example. When the applied pressure exceeds a predetermined threshold, the pressure of the fluid in the annulus ruptures one or more ruptured discs (located in rupture disc assemblies 416), and these rupture(s) permit fluid from the annulus to flow through the middle housing section 402*b* into grooves, or cavities 432 that exist between a shoulder of the middle housing section 402*b* and a lower surface 434 of a shoulder of the mandrel 414. The cavities 423 are located below an O-ring 444 that is located between the exterior surface of the mandrel 414 and the interior surface of the middle housing section 402*b* and above an O-ring 450 that also extends between the outer surface of the mandrel 414 and the inner surface of the middle housing section 402*b*. Thus, the cavities 432 are located within a sealed region. Therefore, when the pressure in the annulus exceeds a predetermined threshold, the rupture discs rupture to cause fluid from the annulus flows into the cavities 432 to exert an upward force on the lower surface 434 to tend to force the mandrel 414 in an upward direction.

Subsequently, when the pressure in the annulus reaches a sufficient level, the shear pins 404 shear under the shear forces presented by the surface 405 contacting the shear pins 404, thereby no longer confining upward travel of the mandrel 414. Therefore, when the shear pins 404 shear, the mandrel 414 is permitted to travel in an upward direction until the upper surface 405 of the mandrel 414 rests against a shoulder 407 that is established by the upper housing section 402*a* and serves as a stop. In this upward position, the radial flow ports 420 of the middle housing section 402*b* are aligned with the radial flow ports 424 of the mandrel 414, thereby permitting fluid communication between the annulus and the central passageway 460 to place the valve in an open state, the state depicted in FIGS. 13 and 14.

Figure 15:
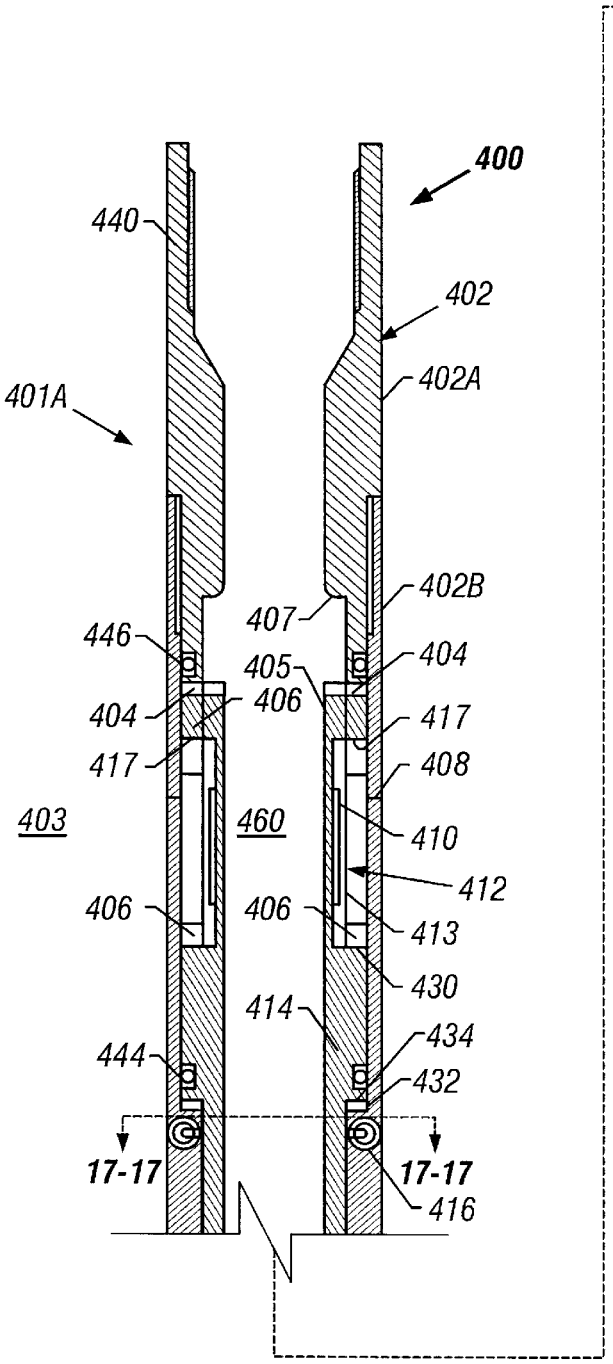
FIGS. 15 and 16 are schematic diagrams of sections of the valve assembly wherein locked in the closed state according to an embodiment of the invention.
Figure 16:
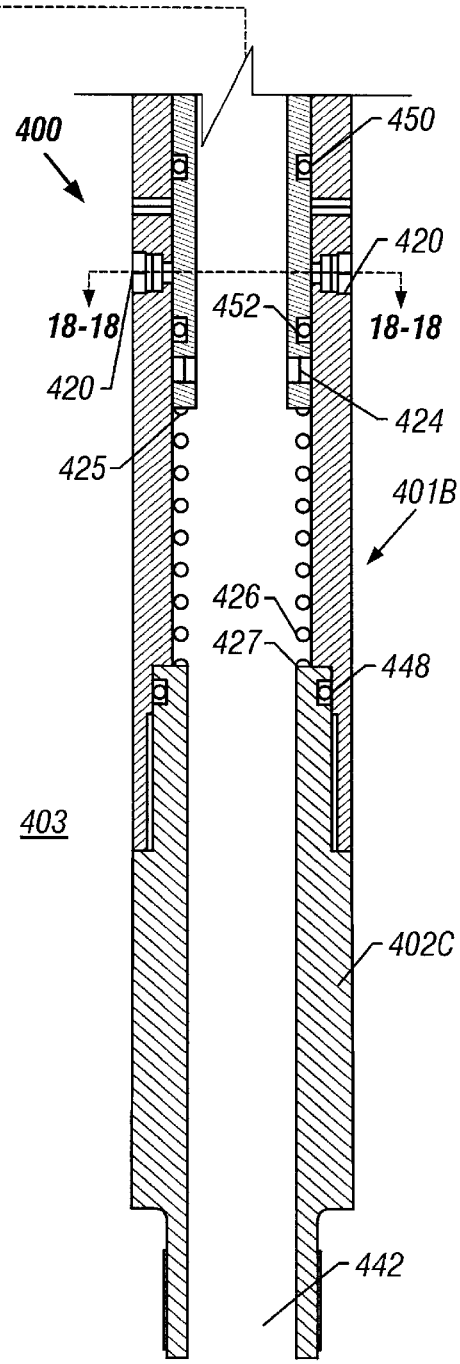

Thus, initially, the valve assembly 400 is closed when the assembly 400 is being run downhole. Thereafter, in a one-shot operation, the pressure in the annulus of the well may be increased to cause the valve assembly 400 to open fluid communication between the annulus and the central passageway 460. As described below, the valve assembly 400 may be subsequently closed and opened in response to a pressure differential that is established between the annulus and the central passageway 460. After a predetermined number of these open and close cycles, the valve assembly 400, in some embodiments of the invention, locks itself in the closed position (in which the mandrel 414 is in its down position) to, as its name implies, permanently close the valve assembly 400. This state of the valve assembly 400 is depicted in FIGS. 15 and 16.

For purposes of making the mandrel 414 responsive to the differential pressure between the annulus and the central passageway 460, in some embodiments of the invention, the flow ports 420 are sized such that a certain pressure drop is created across the flow ports 420 when the rate of fluid flowing from the central passageway 460 to the annulus exceeds a predetermined rate. In this manner, when the flow exceeds a predetermined rate, the differential pressure between the central passageway 460 and the annulus creates a differential pressure that acts on an upper shoulder 430 of the mandrel 414, pushing the mandrel 414 in a downward direction to close off the flow ports 420. A sufficient flow causes the downward force created by this differential pressure to overcome the upward force that is exerted by the compression spring 426 on the mandrel 414.

Thus, in summary, the flow rate between the central passageway 460 and the annulus may be set to the appropriate rate to increase the pressure differential between the central passageway 460 and the annulus to force the mandrel 414 down to close the valve assembly 400. Therefore, by reducing this flow rate, the downward force on the mandrel 414 may be relieved to the extent that the mandrel 414 (due to the force generated by the compression spring 426) is forced in an upward direction to once again open the valve assembly 400. The above-described open and close cycle may be repeated, with the number of open and close cycles being limited by a ratchet mechanism, as described below.

The ratchet mechanism of the valve assembly 400 is similar in design to the ratchet mechanism of the tubing fill valve 300. More specifically, the ratchet mechanism of the valve 400 includes ratchet keys 412, ratchet lugs 406 and flat springs 410. The ratchet keys 412 are regularly spaced about the longitudinal axis of the valve assembly 400. Likewise, each lug 406 is associated with one of the ratchet keys 412, and the lugs 406 are also regularly spaced around the longitudinal axis of the valve assembly 400, as described below. Each ratchet key 412 is located between the mandrel 414 and the middle housing section 402*b* and partially circumscribes the mandrel 414 about the longitudinal axis of the valve assembly 400. Each ratchet key 404 establishes an annular groove or cavity, each of which houses one of the flat spring 410. Each flat spring 410, in turn, maintains an outward radial force on the associated ratchet key 412 to push the ratchet key 412 in a radially outward direction toward the middle housing section 402*b*.

Each ratchet lug 406 is located between an associated ratchet key 412 and the middle housing section 402*b*. When the valve assembly 400 is run downhole, the ratchet lugs 406 are located near a lower surface 417 of the upper housing section 402*b*, as depicted in FIGS. 11 and 12.

The ratchet lug 406 has interior profiled teeth that engage corresponding exterior profiled teeth 413 of the associated ratchet key 412. Likewise, the ratchet lug 406 includes exterior profile teeth that engage corresponding interior profiled teeth 408 located on the inner surface of the middle housing section 402*b*. The shape of the teeth of the lug 406 and the outer and interior surfaces of the ratchet key 412 and middle housing section 402*b* are similar in design to the ratchet mechanism of the valve assembly 300 except that these teeth and surfaces are rotated by 180° (i.e., FIG. 10 is rotated by 180°) to permit the ratchet lugs 406 to move in a downward motion in response to movement of the mandrel 414, as described below.

Due to this configuration, the ratchet lugs 406 move down with the mandrel 414 and are prevented from moving in an upward direction when the mandrel 414 moves in an upward direction. Thus, the ratchet lugs 406 move down with the mandrel 404 every time the mandrel 414 moves down, and when the mandrel 414 subsequently moves in an upward direction, the ratchet lugs 406 stay in place relative to the middle housing section 402*b*. Therefore, a gap that exists between an upward facing surface 430 of the mandrel 404 and the lower surfaces of the ratchet lugs 406 becomes progressively smaller on every open and close cycle of the mandrel 414. On the last open and close cycle, the mandrel 414 moves down but is prevented from moving subsequently in an upward direction because the ratchet lugs 406 abut the surface 430, as depicted in FIG. 15. For this case, as shown in FIG. 16, the radial flow ports 420 are misaligned with the radial flow ports 424 of the mandrel 414 to lock the valve assembly 400 in the closed position.

Thus, to summarize, the valve assembly 400 may be run downhole on a tubular string in its closed state. After the valve assembly 400 is in position, the pressure in the annulus of the well may be increased until the rupture disc in the rupture disc assembly 416 (or multiple disc assemblies) ruptures and permits fluid communication between the annulus and the mandrel 414. When this pressure reaches a sufficient level, the shear pins 404 of the valve assembly 400 shear, thereby allowing the mandrel 414 to move in an upward direction and open the valve assembly 400 to permit fluid communication between the central passageway 460 of the valve assembly 400 and the annulus. By controlling the flow rate between the central passageway 460 and annulus, the valve assembly 400 may be opened and closed for a predetermined number of open and close cycles. After the number of predetermined open and close cycles have occurred, the valve assembly 400 then locks itself in the closed position.

Figure 17:
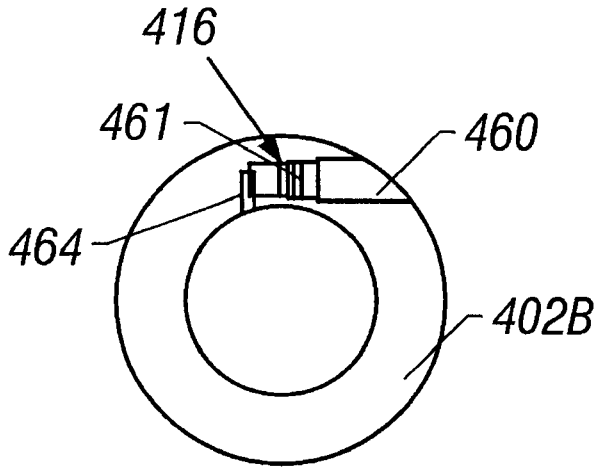
FIG. 17 is a cross-sectional view of the valve assembly taken along line 17—17 of FIG. 11.

Referring to FIG. 17, in some embodiments of the invention, the rupture disc assembly 416 is tangentially situated with respect to the longitudinal axis of the valve assembly 400 and resides in the middle housing section 402*b*. Although one rupture disc assembly 416 is depicted in FIG. 17, the valve assembly 400 may include multiple rupture disc assemblies 416 in other embodiments of the invention, as depicted in the other figures. As shown in FIG. 17, the rupture disc assembly 416 includes a tangential port 460 for receiving fluid from the annulus of the well and a radial port 464 for communicating with the central passageway 460 of the valve assembly 400. A rupture disc 461 is located inside the rupture disc assembly 416 between the tangential port 460 and the radial port 464. Therefore, when the pressure in the annulus exceeds a predetermined threshold, the rupture disc 461 ruptures, to permit fluid communication between the annulus and the central passageway 460.

Figure 18:
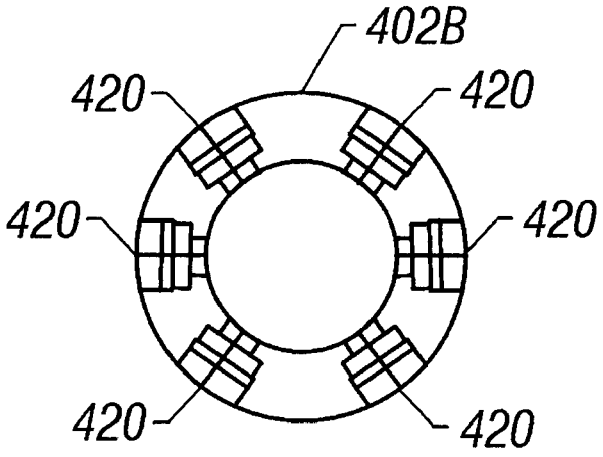
FIG. 18 is a cross-sectional view of the valve assembly taken along line 18—18 of FIG. 12.

Referring to FIG. 18, in some embodiments of the invention, the middle housing section 402 includes the radial flow ports 420, that, as shown, may be regularly spaced around the longitudinal axis of the valve assembly 400. As depicted in FIG. 18, in some embodiments of the invention, the valve assembly 400 may include eight such flow ports 420, although the valve assembly 400 may include fewer or more radial flow ports 420 in other embodiments of the invention. The cross-section of each radial flow port 420 is sized to create the predetermined differential pressure between the annulus and the central passageway 460 when the flow exceeds a certain rate to cause the mandrel 414 to move to close the valve assembly 414.

In the preceding description, directional terms, such as "upper," "lower," "vertical," "horizontal," etc., may have been used for reasons of convenience to describe the completion valve assembly and its associated components. However, such orientations are not needed to practice the invention, and thus, other orientations are possible in other embodiments of the invention.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method usable with a subterranean well, comprising:

running a valve downhole in a first state;

changing the valve to a second state in response to pressure applied to an annular region that surrounds the valve; and changing the valve between the first and second states by regulating a differential pressure between the annular region and an inner passageway of the valve.

2. The method of claim 1, wherein the regulating comprises:

regulating a rate of fluid flow between the annular region and the inner passageway.

3. The method of claim 1, wherein the first state comprises a closed state.

4. The method of claim 1, wherein the second state comprises an open state.

5. The method of claim 1, further comprising:

locking the valve in the first state after a predetermined number of transitions occur between the first and second states.

6. The method of claim 1, wherein the valve comprises a circulation valve.

7. The method of claim 1, wherein the changing the valve to the second state in response to the pressure comprises rupturing a rupture disc.

8. An apparatus usable in a subterranean well, comprising:

a valve to control communication between an annular region that surrounds the valve and an inner passageway of the valve;

a first mechanism to cause the valve to transition from a first state to a second state in response to pressure in the annular region; and a second mechanism to cause the valve to transition between the first state and the second state in response to a pressure differential between the annular region and the inner passageway.

9. The apparatus of claim 8, wherein the second mechanism responds to rate of fluid flow between the annular region and the inner passageway.

10. The apparatus of claim 8, wherein the first state comprises a closed state.

11. The apparatus of claim 8, wherein the second state comprises an open state.

12. The apparatus of claim 8, wherein the second mechanism locks the valve in the first state after a predetermined number of transitions occur between the first and second states.

13. The apparatus of claim 8, wherein the second mechanism comprises a ratchet mechanism.

14. The apparatus of claim 8, wherein the first mechanism comprises at least one rupture disc located between the annular region and the inner passageway.

15. The apparatus of claim 8, wherein the second mechanism comprises at least one radial port.

16. The apparatus of claim 15, wherein the valve comprises a mandrel to change the valve between the first and second states in response to a fluid flow through said at least one radial port.

17. The apparatus of claim 8, wherein the valve comprises a circulation valve.

18. The apparatus of claim 8, wherein:

the valve comprises a mandrel responsive to pressure in the annular region to change the valve between the first and second states, and the first mechanism comprises a shear pin to confine travel of the mandrel to keep the valve in the first state until pressure in the annular region exceeds a predefined threshold.

19. The apparatus of claim 8, wherein the valve comprises a mandrel responsive to pressure in the annular region to change the valve between the first and second states, the second mechanism comprises at least one flow port formed in a housing, and a cross-section of the flow port establishes a predefined pressure differential between the annular region and the inner passageway to cause the mandrel to move to change the valve between the first and second states.

20. The apparatus of claim 8, further comprising:

a mandrel movable in response to the pressure in the annulus to establish the first and second states, wherein the second mechanism comprises a ratchet mechanism to confine movement of the mandrel to lock the valve in the second state in response to the valve transitioning between the first and second states a predetermined number of times.

21. An apparatus for use with a subterranean well comprising:

a tubular member having a longitudinal passageway and at least one port for establishing communication between the passageway and an annular region that surrounds the tubular member; and a valve adapted to open and close the port and lock the valve closed after the valve closes more than a predetermined number of times.

22. The apparatus of claim 21, wherein the valve comprises a tubing fill valve.

23. The apparatus of claim 21, wherein the valve comprises:

a mandrel adapted to move in the tubular member to open and close communication through said at least one port; and a ratchet mechanism to lock a position of the mandrel to keep the valve closed after the valve closes more than the predetermined number of times.

24. The apparatus of claim 23, wherein a first surface of the tubular member has first teeth, the ratchet mechanism comprising:

a ratchet key having second teeth and being fixed to the mandrel;

a ratchet lug located between the first and second teeth; and a spring to bias the ratchet key to permit the ratchet lug to move with respect to the first teeth in a first direction when the mandrel moves in the first direction to close the valve and not move in a second direction with respect to the first teeth when the mandrel moves in the second direction to open the valve.

25. The apparatus of claim 24, wherein the mandrel comprises a shoulder and the ratchet lug contacts the shoulder to prevent the mandrel from moving to open the valve when the valve closes more than the predetermined number of times.

* * * * *